US005781838A

United States Patent [19]

Suzuki

[11] Patent Number: 5,781,838

[45] Date of Patent: Jul. 14, 1998

[54] TONER SUPPLYING DEVICE FOR USE IN IMAGE FORMING APPRATUS

[75] Inventor: Tsuyoshi Suzuki, Owariasahi, Japan

[73] Assignee: Brother Kogyo Kabushiki kaisha, Nagoya, Japan

[21] Appl. No.: 862,705

[22] Filed: May 23, 1997

[30] Foreign Application Priority Data

May 27, 1996 [JP] Japan ..... 8-131596

[51] Int. Cl.[6] ..... G03G 15/08

[52] U.S. Cl. ..... 399/281; 399/272

[58] Field of Search ..... 399/258, 252, 399/265, 279, 286, 272, 281

[56] References Cited

U.S. PATENT DOCUMENTS 4,480,911 11/1984 Itaya et al. ..... 399/282
4,930,438 6/1990 Demizu .
5,172,169 12/1992 Takashima et al. .
5,339,141 8/1994 Suzuki et al. ..... 399/285
5,489,747 2/1996 Takenaka et al. .
5,623,717 4/1997 Takenaka et al. ..... 399/281
5,655,197 8/1997 Okada et al. .

*Primary Examiner*—R. L. Moses
*Attorney, Agent, or Firm*—Oliff & Berridge, PLC

[57] ABSTRACT

The toner supply roller 20 is so constructed that the outer diameter L of the toner supply roller 20 is set in a range of 10–13 mm, the outer diameter M of the roller shaft 20B is set in a range of 5–6 mm, and a difference between the distance between the rotating center E1 of the toner supply roller 20 and the rotating center E2 of the developing roller 19 and the sum of the radius R1 of the toner supply roller 20 and the radius R2 of the developing roller 19, i.e., the compression amount is set in a range of 0.5–0.8 mm so that there is a good balance between the rigidity of the roller shaft 20B and the rigidity of the roller member 20C. Accordingly, this makes it possible to use the toner supply roller 20 having a small roller diameter L and to supply just sufficiently toner to the developing roller 19. As a result, a resultant image excellent in image quality can be formed for a long period.

10 Claims, 6 Drawing Sheets

PRIOR ART

TONER SUPPLYING DEVICE FOR USE IN IMAGE FORMING APPRATUS

BACKGROUND OF THE INVENTION

1. Field of the Invention

The present invention relates to a toner supplying device for use in an image forming apparatus such as a laser printer, etc., for developing an electrostatic latent image by supplying toner to the electrostatic latent image formed on an outer peripheral surface of a photosensitive drum and transferring the image developed on the surface of the photosensitive drum onto a sheet, and particularly to a toner supplying device for use in an image forming apparatus, capable of being provided with a toner supply roller having a smaller roller diameter while balancing rigidity of a roller shaft and rigidity of a porous elastomer covering the periphery of the roller shaft, and also of providing toner just sufficiently from the toner supply roller to the developing roller, thus forming for a long period a resultant image, i.e., a visual image excellent in image quality.

2. Description of Related Art

Regarding conventional toner supplying devices for use in image forming apparatuses such as laser printers, etc., there have been proposed various types of the devices, which are in general constructed of a toner storing member including a toner cartridge for storing therein toner, a toner supply roller for supplying toner from the toner storing member, and a developing roller for supplying the toner provided from the toner supply roller onto an electrostatic latent image on a photosensitive drum to develop the image with toner. One embodiment of the toner supplying device will be explained with reference to FIG. 7. FIG. 7 is an explanatory view showing schematically a main construction of the toner supplying device in the prior art.

In FIG. 7, the toner supplying device has a toner cartridge 100 which accommodates therein toner and is provided with an opening for toner supply at an almost center in its width direction. This toner cartridge 100 is provided therein with an agitator 103 for agitating toner to supply same into a developing chamber 102 side through a toner supply port 101. A frame F of the toner supplying device is provided with an opening for toner supply positioned correspondingly to the toner supply opening of the toner cartridge 100. Those openings of the toner cartridge 100 and the frame F form the toner supply port 101 in combination with each other. Inside the developing chamber 102 constructed of an upper frame F1 and a lower frame F2 of the frame F, a toner supply roller 104 is arranged rotatably at a lower frame F2 side, for supplying the toner supplied through the toner supply port 101 to a developing roller 105.

This toner supply roller 104 is constructed of a roller shaft 104A formed of metal (various steel materials, for example) and a sponge member 104B covering the periphery of the roller shaft 104A. The developing roller 105 is usually formed of a material which is harder than that of the sponge member 104B. At the time of supplying toner from the toner supply roller 104 to the developing roller 105, the toner supply roller 104 is made to be in contact with the developing roller 105 as the sponge member 104B is somewhat compressed against the developing roller 105.

Furthermore, on an internal wall of the upper frame F1, above the developing roller 105, a blade 107 is fixedly secured with a fixing element 106, whereby to regulate a thickness of the toner layer supplied on the surface of the developing roller 105. This developing roller 105 is also arranged in contact with a photosensitive drum 108. On the peripheral surface of the photosensitive drum 108 is formed an electrostatic latent image by an image exposure device not shown which performs a scanning operation with a laser beam in accordance with image data. The developing roller 105 supplies toner to the electrostatic latent image formed on the peripheral surface of the photosensitive drum 108 to develop the image. The image developed on the surface of the photosensitive drum 108 is then transferred onto a sheet fed from a sheet feeder not shown, forming a resultant image thereon.

Meanwhile, to achieve the decrease of costs of the image forming apparatus on which the conventional toner supplying device is mounted by compactizing the apparatus, it needs to reduce both the length and the roller diameter of the toner supply roller 104. This toner supply roller 104 being constructed of the roller shaft 104A and the sponge member 104B, it is necessary to pay attention to the balance between the rigidity of the roller shaft 104A and that of the sponge member 104B. If the balance is not well, many problems may be caused. For instance, in the case that the roller diameter of the toner supply roller 104 is set less than a fixed value (less than 12 mm, for example), if the diameter of the shaft 104A is too small, the shaft 104A will be bent at the time of supplying toner to the developing roller 105 due to the insufficiency of the rigidity of the shaft 104A. As a result, the sponge member 104B is not allowed to uniformly come into contact with the developing roller 105, so that it causes an inferior charging of the toner held on a center part of the sponge member 104B, resulting in the clogging with the toner. To the contrary, if the diameter of the shaft 104A is too large, the shaft 104A does not bend because of the sufficient rigidity, but the sponge member 104 the thickness of which being reduced can not sufficiently hold toner thereon, resulting in an insufficient supply of toner to the developing roller 105.

On the other hand, if the rigidity of the sponge member 104B is too small, the compression amount of the sponge member 104B against the developing roller 105 becomes excessive when the sponge member 104B supplies toner to the developing roller 105. This causes problems that the rotational torque to the toner supply roller 104 increases and the developing roller 105 is shaved. The clogging with toner also occurs.

If the rigidity of the sponge member 104B is too large, to the contrary, the compression amount of the sponge member 104B become smaller. This causes the inferior charging of the toner held on the sponge member 104B.

SUMMARY OF THE INVENTION

The present invention has been made in view of the above circumstances and has an object to overcome the above problems and to provide a toner supplying device for use in an image forming apparatus, capable of being provided with a toner supply roller having a smaller roller diameter while keeping a proper balance between the rigidity of a shaft and that of a porous elastomer covering the shaft of the toner supply roller, and thereby supplying toner just sufficiently from the toner supply roller to the developing roller so that a resultant image can be formed for a long time with an excellent image quality.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a toner supplying device for use in an image forming apparatus in claim 1 of this invention, for developing an electrostatic latent image formed on an outer peripheral surface of a photosensitive drum by supplying toner to the image, and then transferring the developed image onto a sheet to form a resultant image, the toner supplying device comprising a toner storing member, a toner supply roller for supplying toner transported from the toner storing member, constructed of a roller shaft and a porous elastomer covering a periphery of the roller shaft, an outer diameter of the toner supply roller being set in a range of 10–13 mm and an outer diameter of the roller shaft being set in a range of 4.5–6.5 mm, and a developing roller for supplying the toner supplied from the toner supply roller to the electrostatic latent image formed on the surface of the photosensitive drum to develop the image, a distance between a rotating center of the toner supply roller and a rotating center of the developing roller being set shorter by 0.5 mm–0.8 mm than a sum of a radius of the toner supply roller and a radius of the developing roller.

According to the above toner supplying device of the present invention, the toner supply roller is so constructed that a good balance can be kept between the rigidity of the roller shaft and the rigidity of the porous elastomer by setting the outer diameter of the toner supply roller, the outer diameter of the roller shaft, and the relation between the distance between the rotating center of the toner supply roller and the rotating center of the developing roller and the sum of the radius of the toner supply roller and the radius of the developing roller into individual predetermined ranges, so that the roller diameter of the toner supply roller can be reduced and the just sufficient supply of toner from the toner supply roller to the developing roller can be achieved. It is therefore to possible to form a long period a resultant image excellent in image quality.

The developing device according to claim 2 is characterized in that, in the developing device of claim 1, the toner supply roller and the developing roller are driven to rotate in the same direction.

The developing device according to claim 3 is characterized in that, in the developing device of claim 1, the developing roller is formed of elastomer which is harder than the porous elastomer of the toner supply roller.

The developing device according to claim 4 is characterized in that, in the developing device of claim 1, a width of the porous elastomer of the toner supplying roller is set to 200 mm or more and 290 mm or less.

The developing device according to claim 5 is characterized in that, in the developing device of claim 1, a difference between the distance between the rotating center of the toner supply roller and the rotating center of the developing roller and the sum of the radius of the toner supply roller and the radius of the developing roller corresponds to a compression amount of the porous elastomer.

According to the present invention, it is possible to provide a toner supplying device for use in an image forming apparatus, wherein the roller diameter of the toner supply roller can be reduced while a good balance is kept between the rigidity of the roller shaft of the toner supply roller and the rigidity of the porous elastomer, and a sufficient supply of toner from the toner supply roller to the developing roller can be achieved, thus enabling to form for a long period a resultant image excellent in image quality.

The developing device according to claim 6 is characterized in that, in the developing device of claim 1, the porous elastomer is made of sponge material.

The developing device according to claim 7 is characterized in that, in the developing device of claim 3, the elastomer of the developing roller is made of hard rubber.

The developing device according to claim 8 is characterized in that, in the developing device of claim 1, the outer diameter of the toner supply roller is set in a range of 11.5 mm±0.5 mm.

The developing device according to claim 9 is characterized in that, in the developing device of claim 1, the outer diameter of the roller shaft of the toner supply roller is set in a range of 5 mm±0.5 mm.

The developing device according to claim 10 is characterized in that, in the developing device of claim 1, the distance between the rotating center of the toner supply roller and the rotating center of the developing center of the developing roller is set in a range of 0.6±0.1 mm.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

A detailed description of a preferred embodiment of a toner supplying device for use in an image forming apparatus, specifically in a laser printer, embodying the present invention will now be given referring to the accompanying drawings.

Figure 1:
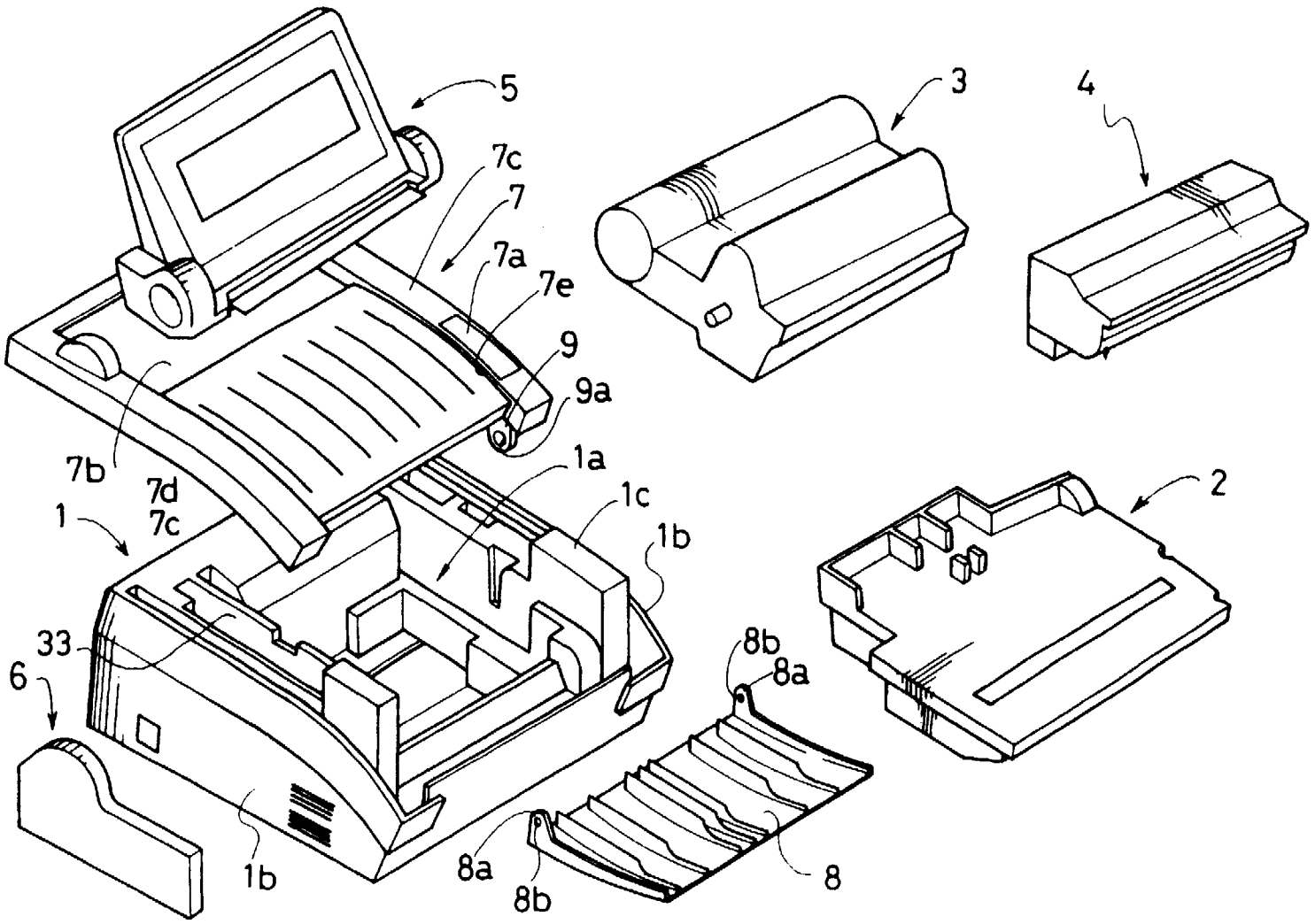
FIG. 1 is a perspective exploded view of main components of a laser printer in an embodiment according to the present invention.
Figure 2:
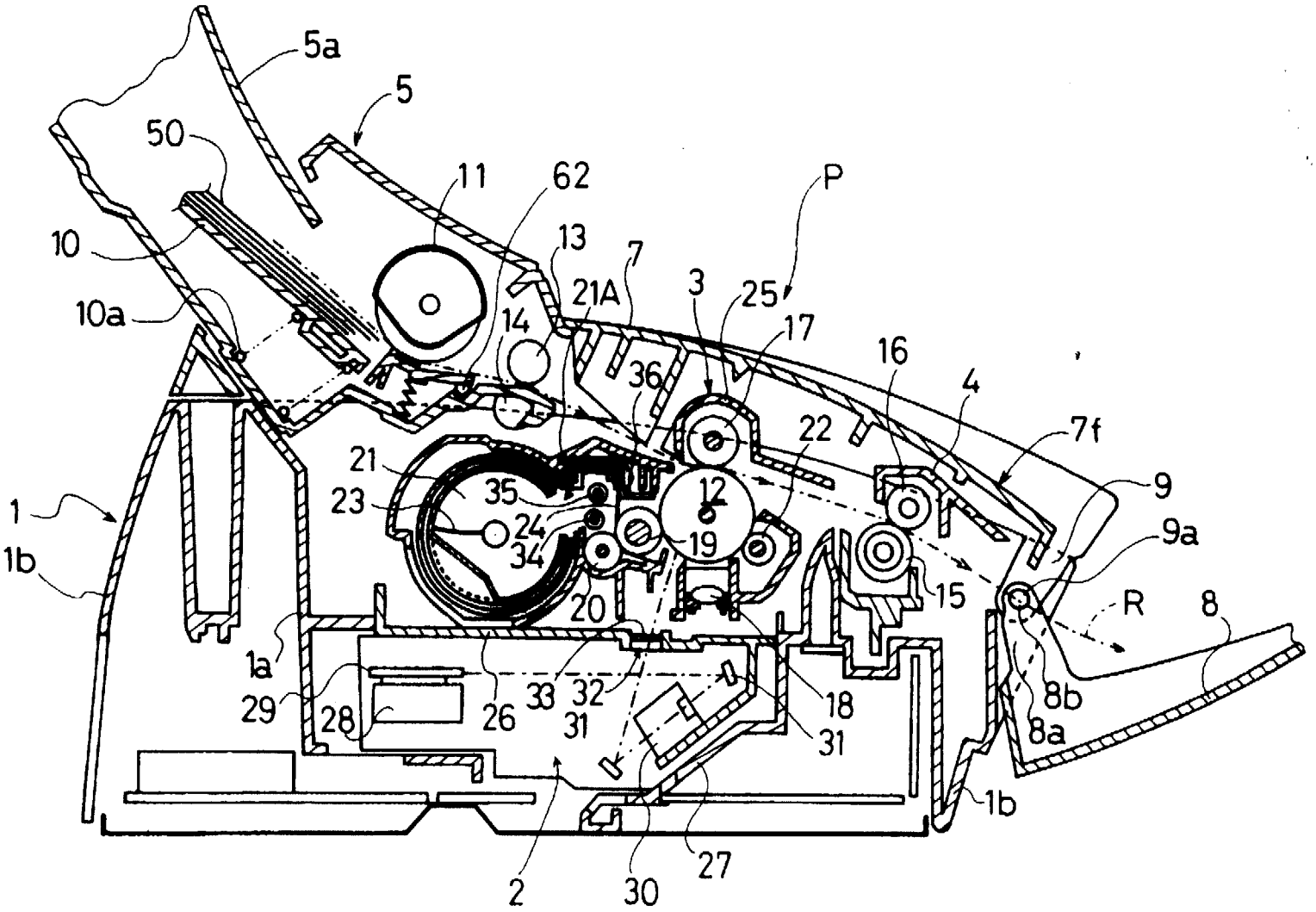
FIG. 2 is a sectional side view of the laser printer of FIG. 1.

First, schematic construction of a laser printer P in the present embodiment will be described with reference to FIGS. 1 and 2. FIG. 1 is a perspective exploded view of a main construction of the laser printer P. FIG. 2 is a sectional side view of the laser printer P.

In FIG. 1, a main housing 1 of the laser printer P is formed integrally of a main frame 1*a* and a main cover 1*b* by, for example, an injection molding process. In the main unit 1*a*, set are a scanner unit 2, a process unit 3, a fixing unit 4, and a sheet supply unit 5 from above the main unit 1*a*. The main cover 1*b* serves to cover the outer peripheral four side surfaces, i.e., a front, back, right, and left sides, of the main frame 1*a*. In a holding recess 33 defined by the outer surface of the main frame 1*a* and the inner surface of the main cover 1*b*, a driving system unit 6 including a driving motor and a train of gears is installed and fixed from the lower side of the main housing 1.

The main frame 1*a* is provided with an operational panel 1*c* formed extruding upward. Both upper surfaces of the main frame 1*a* and the main cover 1*b* are covered with an upper cover 7. This upper cover 7 is provided with a hole 7*a* through which the operational panel 1*c* can be inserted and an opening 7*b* through which a base part of the sheet supply unit 5 can be inserted. At both sides in a front side of the upper cover 7 (a right side in FIG. 1), a pair of brackets 9 each having a support shaft 9*a* extruding opposite to each other (only one of them is shown in FIG. 1). A sheet discharge tray 8 is provided with support portions 8*a* formed at both end sides thereof and bores 8*b* formed in the support portions 8*a*. Each of the bores 8*b* can be fitted to each support shaft 9*a* of the brackets 9 so that the sheet discharge tray 8 is supported rotatably with respect to the upper cover 7. On the upper surface of the upper cover 7, there are provided step portions 7*e* between the upper surfaces of side parts 7*c* and the upper surface of a center part 7*d*. Such the step portions 7*e* form a holding recess 7*f* as shown in FIG. 2 for holding the sheet discharge tray 8 in the center part 7*d* of the upper cover 7 during non-use of the tray 8. The sheet discharge tray 8 in non-use can be held in the holding recess 7*f* by turning about the support portions 8*a* to a position where it is held in the upper cover 7 and, to the contrary, it can be set for use at a position to stack the sheets discharged from the fixing unit 4 by turning contrariwise from the held position to a stack position shown in FIG. 2.

Next, the schematic internal structure of the laser printer P will more detail be explained referring to FIG. 2. In FIG. 2, sheets 50 are held as stacked in a feeder case 5*a* of the sheet supply unit 5. The tip end of each sheet 50 is pressed against a sheet supply roller 11 by a supporting plate 10 provided with a biasing spring 10*a*, disposed inside the feeder case 5*a*. The sheet supply roller 11 is driven to rotate by a driving power transmitted from the driving system unit 6 and transport individual sheets from the feeder case 5*a* in cooperation with a sheet separating member 62. The sheet 50 individually separated from the sheet stack is transported to the process unit 3 by means of a pair of resist rollers 13 and 14.

The process unit 3 is a unit to perform toner development of electrostatic latent image by supplying toner to the electrostatic latent image formed on the peripheral surface of the photosensitive drum 12 by means of a laser optical system which will be mentioned later, provided in the scanner unit 2 in accordance with image data. More specifically, the process unit 3 is constructed of the photosensitive drum 12, a transfer roller 17 disposed above the photosensitive drum 12 and in contact therewith, a charger 18 such as a Scorotron type of charger, disposed under the photosensitive drum 12, a developing unit including a developing roller 19 disposed upstream of the photosensitive drum 12 in a sheet feeding direction and a toner supply roller 20, a toner cartridge 21 attachably and detachably disposed upstream of the developing unit, which serves as a toner storing unit, and a cleaning roller 22 disposed downstream of the photosensitive drum 12, and other components.

Inside of a developing chamber of the developing unit, a pair of auger rollers, namely, a lower auger roller 34 and an upper auger roller 35, are rotatably arranged above the toner supply roller 20. This lower auger roller 34 functions to transport the toner supplied from the toner cartridge 21 via a toner supply port 21A into the developing chamber, toward both sides of the toner supply roller 20 above the toner supply roller 20. The toner supply port 21A is constructed of an opening formed in the toner cartridge at an almost center position thereof and an opening formed in a unit frame 25. The upper auger roller 35 functions to transport the toner from the both sides of the toner supply roller 20 toward the toner supply port 21A. In this way, the toner is supplied from the toner supply port 21A to the developing chamber side by means of the upper and lower auger rollers 35 and 34, thereby to circulate above the toner supply roller 20 in the both sides thereof. While circulating, the toner is supplied to and stuck on the toner supply roller 20. The detail structure of each of the lower auger roller 34 and the upper auger roller 35 will be described later.

Above the developing roller 19, a blade 24 is secured with an L-shaped blade fixing element 36 on a lower surface of the unit frame 25. The blade 24 serves to regulate the thickness of a layer of toner supplied on the developing roller 19 from the toner supply roller 20 into a predetermined thickness.

On the outer peripheral surface of the photosensitive drum 12, an electrically charged layer is formed by the charger 18 and, then, an electrostatic latent image is formed thereon by scanning with a laser beam by means of the scanner unit 2. The toner stored in the toner cartridge 21 is stirred by an agitator 23 thereby to discharge the toner through the toner supply port 21A toward the developing chamber, and is held on the outer peripheral surface of the developing roller 19 via the toner supply roller 20, where the toner on the developing roller 19 is regulated to form a toner layer having a predetermined thickness by means of the blade 24. When the toner is transported from the developing roller 19 to and supplied on the photosensitive drum 12, the electrostatic latent image formed on the photosensitive drum 12 is visualized and transferred to the sheet 50 passing between the transfer roller 17 and the photosensitive drum 12. The residual toner remaining on the photosensitive drum 12 is transported to the cleaning roller 22.

The process unit 3 constructed as above is made as a cartridge type by assembling main components into the unit frame 25 formed of synthetic resin. This cartridge-type process unit 3 is detachably mounted in the main frame 1*a*.

The scanner unit 2 is provided with a well known laser optical system and makes a scanning on the photosensitive drum 12 by the laser optical system in accordance with predetermined image data, thereby forming an electrostatic latent image on the photosensitive drum 12. More specifically, the scanner unit 2 is arranged under the process unit 3 and a scanner cover 26 is attached on the upper surface of the scanner unit 3. This scanner cover 26 is fixed at the upstream side of a bottom plate 27 of the main frame 1*a*, covering substantially the whole opening of the main frame 1*a*, and is provided with an oblong scanner hole 32 extending along the axis line of the photosensitive drum 12. The scanner unit 2 serving as an exposure unit is provided with a laser emitting element 28, a polygon mirror 29, a lens 30, and a reflecting mirror 31, in which a laser beam is allowed to pass through a glass plate 33 inserted in the oblong scanner hole 32 formed in the scanner cover 26 and is emitted to the outer peripheral surface of the photosensitive drum 12 in the process unit 3. Accordingly, the electrostatic latent image is exposed on the outer peripheral surface of the photosensitive drum 12 in accordance with the image data. To the electrostatic latent image formed on the photosensitive drum 12 by the laser optical system of the scanner unit 2 in the above way, the toner is supplied through the process unit 3 to develop the electrostatic latent image.

The developed image based on the electrostatic latent image formed on the photosensitive drum 12 in the process unit 3 is transferred onto the sheet 50 fed to the process unit 3. After that, the sheet 50 is transported to the fixing unit 4 where the toner image transferred onto the sheet 50 is subjected to a heat fixing process by means of a pair of a heat roller 15 and a pressure roller 16. The sheet 50 on which the resultant image (visual image) is formed is then discharged by the rollers 15 and 16 and is stacked onto the sheet discharge tray 8 disposed at a stack position. A path along which the sheet 50 is transported from the sheet supply unit 5 to the sheet discharge tray 8 is indicated by a two-dot chain line R in FIG. 2.

Figure 3:
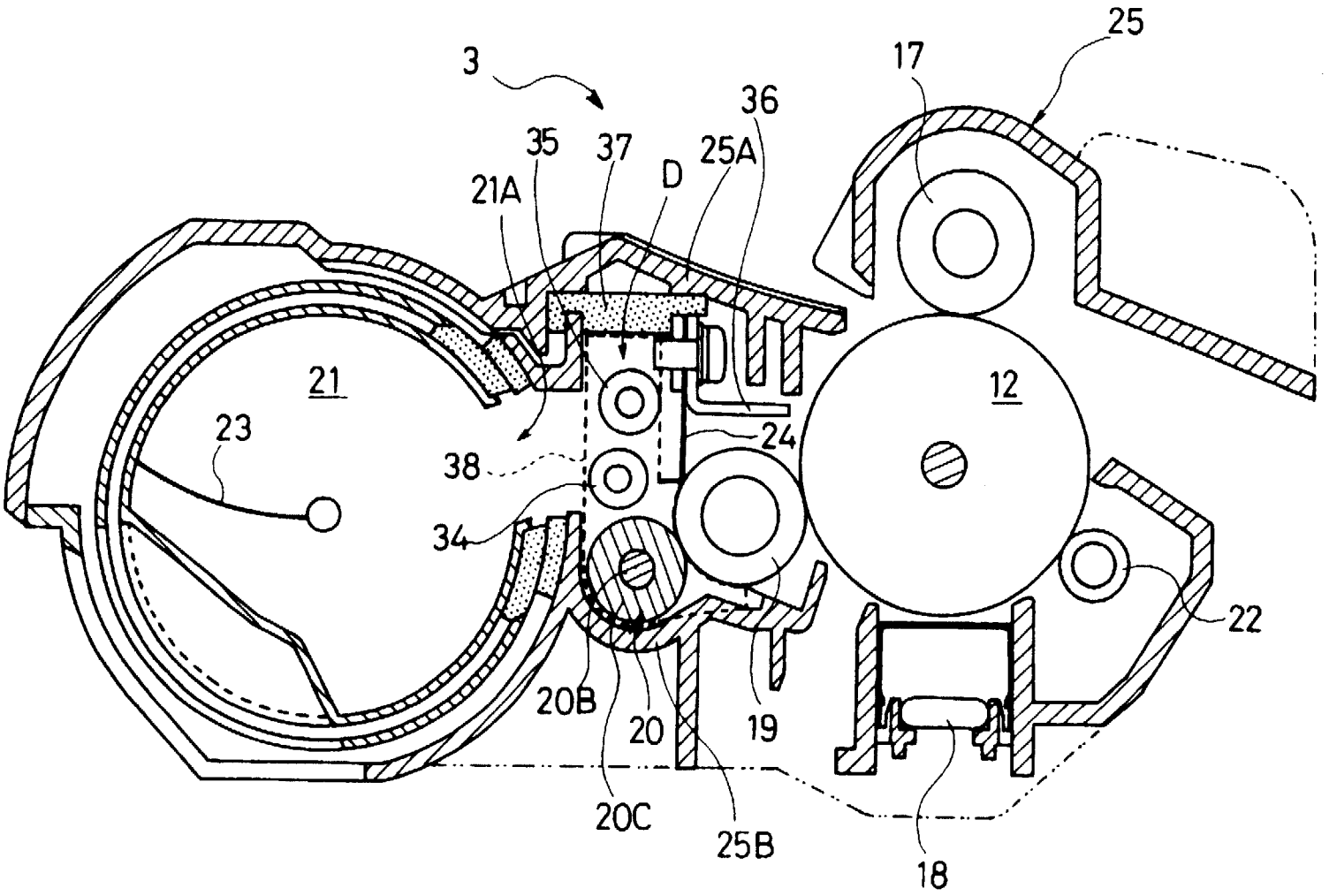
FIG. 3 is a sectional side view of a process unit of the laser printer of FIG. 1.

Next, the detail structure of the developing chamber in the process unit 3 will be described with reference to FIG. 3 through FIG. 5 hereinafter. FIG. 3 is a sectional side view of the process unit 3, FIG. 4 is a schematic explanatory view schematically showing a state where the toner supply roller is in contact with the developing roller 19, and FIG. 5 is a sectional front view showing the internal structure of a developing chamber in the embodiment.

Figure 5:
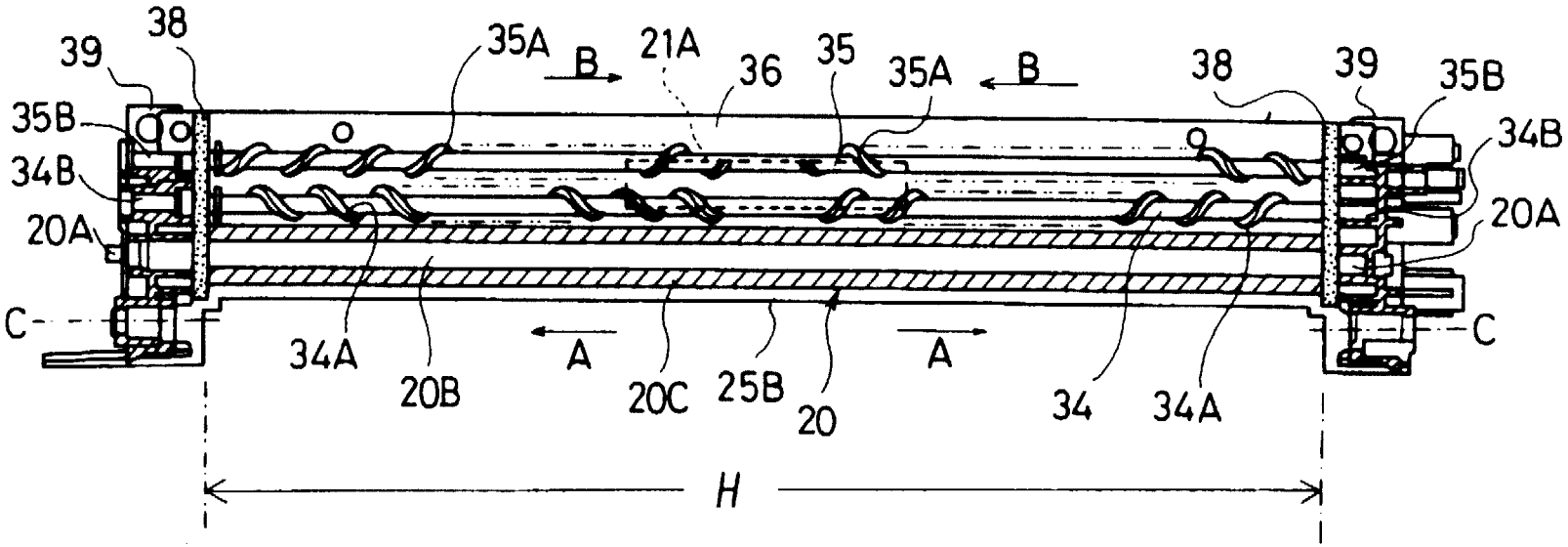
FIG. 5 is a sectional front view showing the internal construction of a developing chamber in the embodiment.

The developing chamber D is a space defined by an upper seal member 37 disposed at a lower surface of an upper frame 25A of the unit frame 25, a lower frame 25B of the unit frame 25, and a pair of side seal members 38 shown in FIG. 5 formed of sponge material, disposed at both sides inside the developing chamber D. The toner supply roller 20 is constructed of a main shaft 20B provided at its both ends with end shafts 20A, and a roller member 20C formed of a porous elastomer such as sponge material covering an outer periphery of the main shaft 20B. Each of the end shafts 20A is inserted in each hole of the side seal member 38 and supported at an outer side thereof with each of the supporting plates 39 attached rotatably to the lower frame 25B (see FIG. 5).

Here, the detail structure of the toner supply roller 20 and the developing roller 19 will be explained with reference to FIG. 4. In FIG. 4, the outer diameter L of the toner supply roller 20 is set to a range of 10–13 mm. Preferably, the outer diameter L is set in a range of 11.5 mm±0.5 mm. This is because the diameter L of the toner supply roller 20 is required to be reduced as much as possible in order to compactize the laser printer P. The outer diameter M of the roller shaft 20B is set to a range of 4.5–6.5 mm. Preferably, the outer diameter M is set in a range of 5 mm±0.5 mm. The reason why the outer diameter M is determined in the above range that the roller shaft 20B is formed of free-cutting steel (on which a process such as a Nickel-plating and the like is applied when necessary) and the rigidity thereof determined based on the outer diameter M can appropriately be balanced with the rigidity of the roller member 20C which is determined based on the compression amount mentioned later of the roller member 20C formed of a porous elastomer. The width (length) H of the roller member 20C (see FIG. 5) is set to a range of 200–290 mm. This is because a proper balance can be kept between the rigidity of the roller shaft 20B determined based on the outer diameter M of the roller shaft 20B and the rigidity of the roller member 20C determined based on the compression amount.

Figure 4:
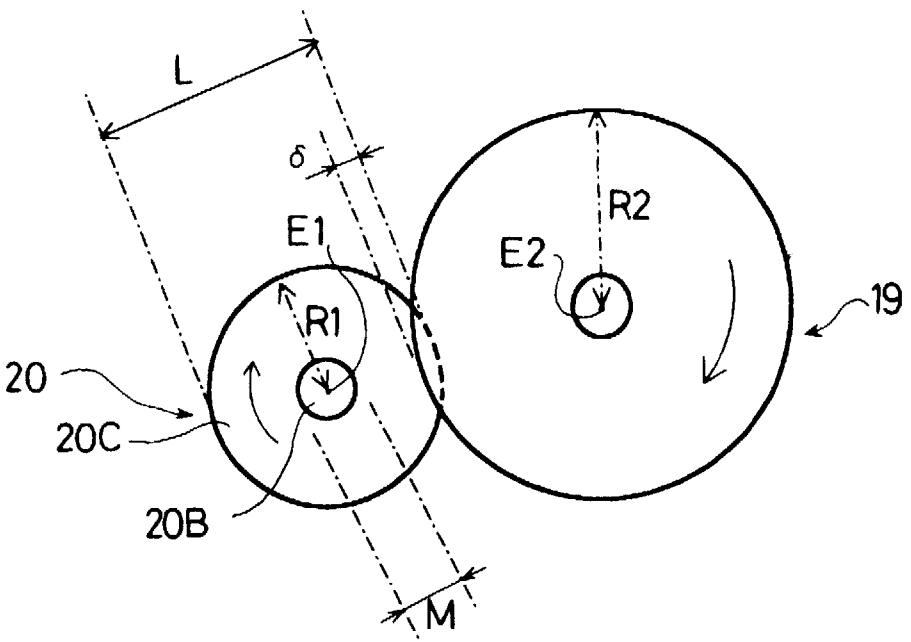
FIG. 4 is an explanatory view schematically showing a state where a toner supply roller is in contact with a developing roller.

The developing roller 19 is formed of an elastomer such as hard rubber which is harder than the roller member 20C of the toner supply roller 20, so that the toner supply roller 20 supplies toner to the developing roller 19 while the toner supply roller 20 being compressed against the developing roller 19 as shown in FIG. 4. At this time, the distance between the rotating center El of the toner supply roller 20 and the rotating center E2 of the developing roller 19 is set shorter by δ than the sum of the radius R1 of the toner supply roller 20 and the radius R2 of the developing roller 19. This value δ is set in a range of 0.5–0.8 mm. Preferably, the value δ is set in a range of 0.6 mm±0.1 mm. In other words, the compression amount of when the roller member 20C of the toner supply roller 20 is compressed against the developing roller 19 formed of elastomer at the time of supply of toner is indicated by δ. Here, the compression amount δ is an index indicating the rigidity of the roller member 20C.

Since both the toner supply roller 20 and the developing roller 19 are driven to rotate in a clockwise direction in the drawing, i.e., in the same direction, a smoother flow of toner can achieved if a difference of rotating speed between the toner supply roller 20 and the developing roller 19 is properly determined.

The turning center (axis) of each supporting plate 39 is indicated by an alphabet C in FIG. 5. Each supporting plate 39 also supports rotatably the developing roller 19, so that each supporting plate 39 is biased in a clockwise direction in FIG. 3 by means of a biasing spring (not shown) to rotate clockwise about the center C, making the developing roller 19 to come into contact with the photosensitive drum 12. With the support plates 39, the toner supply roller 20, the upper and lower auger rollers 35 and 34, and the developing roller 19 are supported integrally, making it possible to easily regulate a positional relation among the above components by handling them as a unit and thus to easily conduct the maintenance thereof.

As shown in FIG. 5, furthermore, the lower auger roller 34 in which a center portion 34C thereof is substantially correspondent to a position where the toner supply port 21A is formed (corresponding to a center portion of the toner supply port 21A), is provided with spiral teeth 34A formed spirally extending from the center portion 34C toward opposite ends of the auger roller 34 on the outer surface thereof. A roller shaft 34B of the auger roller 34 is supported at both ends thereof with the supporting plates 39 as well as the toner supply roller 20 is. When the lower auger roller 34 is rotated clockwise in FIG. 3, accordingly, the toner supplied from the toner supply port 21A is transported successively along the spiral teeth 34A above the toner supply roller 20 toward both ends of the developing chamber D in opposite directions indicated by arrows A. Similarly, a center portion 35C of the upper auger roller 35 is substantially correspondent to a position where the toner supply port 21A is formed (corresponding to a center portion of the toner supply port 21A). The upper auger roller 35 is provided with spiral teeth 35A formed spirally extending from both ends of the auger roller 35 toward the center portion 35C. A roller shaft 35B of the auger roller 35 is supported with the supporting plates 39 as well as the upper auger roller 34 is. When the upper auger roller 35 is rotated clockwise in FIG. 3 and the toner transported by the lower auger roller 34 toward the both ends of the developing chamber D is so increased to reach the upper auger roller 35, the toner is transported successively along the spiral teeth 35A in directions indicated by arrows B toward the toner supply port 21A. Thus, a part of the toner is returned to the toner cartridge 21 through the toner supply port 21A. In this way, the toner not used for image development is circulated as above and returned to the toner cartridge 21, so that it can prevent toner from remaining in the developing chamber D for a long time. This makes it possible to supply constantly fresh toner from the toner cartridge 21. Even if the toner is not returned to the toner cartridge 21, stirring and circulating by the upper and lower auger rollers 35 and 34 makes toner smoothly flow in the developing chamber D without agglomeration of toner.

As mentioned above, each of the upper and lower auger rollers 35 and 34 serves to transport and circulate the toner supplied from the toner supply port 21A into the developing chamber D, above the toner supply roller 20, thereby enabling uniform supply of toner to all the toner supply roller 20 over without allowing the toner to remain in a limited part. As toner is transported and circulated above the toner supply roller 20 and in its both side directions by means of the upper and lower auger rollers 35 and 34, constantly fresh toner can be supplied on all over the toner supply roller 20, making it possible to supply uniformly toner to the developing roller 19 and the electrostatic latent image formed on the outer peripheral surface of the photosensitive drum 12, thereby to form for a long time the resultant image excellent in quality.

Furthermore, the forming position of the toner supply port 21A in the toner cartridge 21 (a center position of the toner supply port 21A) substantially coincides with the center positions 35C and 34C of the upper and lower auger rollers 35 and 34, so that the toner discharged through the toner supply port 21A can efficiently be transported and circulated above the toner supply roller 20 via the upper and lower auger rollers 35 and 34.

Figure 6:
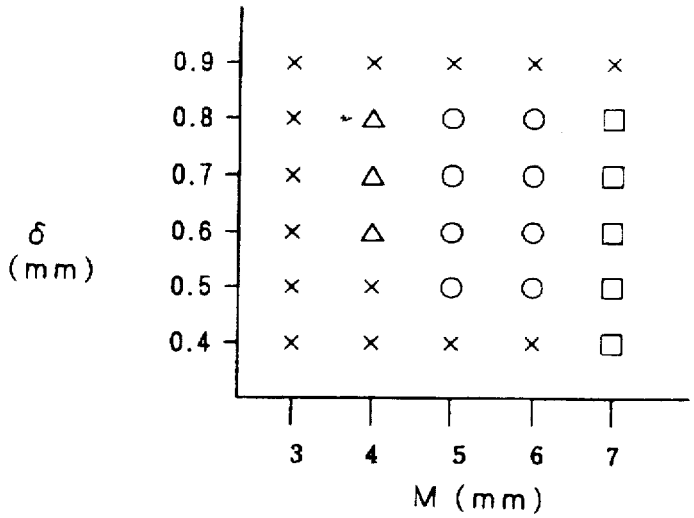
FIG. 6 is a table showing a relation between an outer diameter M, a compression amount δ, and an image quality of a resultant image.
Figure 7:
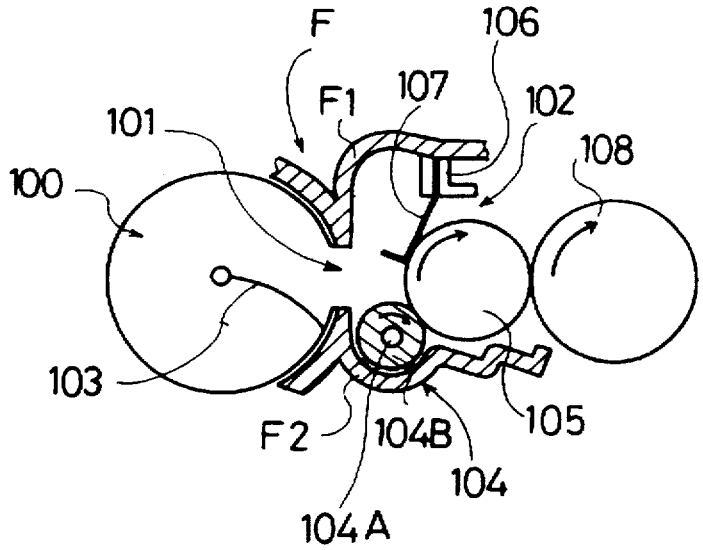
FIG. 7 is an explanatory view schematically showing a main part of a toner supplying device in the prior art.

Next, explained is the influence of changes of the outer diameter M and the compression amount δ on the quality of a resultant image in the case that an image forming operation is conducted using the toner supplying device constructed as above, referring to FIG. 6, while changing the outer diameter M of the roller shaft 20B and the compression amount δ of the roller member 20C. FIG. 6 is a table which shows the relation between the outer diameter M, the compression amount δ, and the image quality of the resultant image in the case of variously changing the outer diameter M and the compression amount δ. In FIG. 6, a horizontal axis indicates the outer diameter M (unit: mm) and a vertical axis indicates the compression amount δ (unit: mm). A mark "○" represents a result that the resultant image wholly excellent in image quality could be obtained even after an image forming operation has been performed on predetermined sheets (for example, 10,000 sheets). A mark "Δ" represents a result that a part of the resultant image was not good in image quality after an image forming operation under the same condition as above. A mark "×" represents a result that there occurred a deterioration of the image quality of the whole resultant image after the image forming operation under the same condition as above. And a mark "□" represents that toner could not sufficiently been supplied to the developing roller 19.

As clearly from FIG. 6, it is found that the deterioration in image quality of the whole resultant image occurred even if changing the compression amount δ of the roller member 20C in the range of 0.4–0.9 mm in the case that the outer diameter M of the roller shaft 20B was 3 mm. For this reason, it is conceivable that the insufficiency of the rigidity of the roller shaft 20B resulted from the outer diameter M of the roller shaft 20B being too small makes the roller shaft 20B be bent in supplying toner to the developing roller 19, preventing the roller member 20C from coming into uniformly contact with the developing roller 19, thus causing the occurrence of an inferior charging of the toner carried on the center part of the roller member 20C.

It is also found that, in the case of the outer diameter M being mm, a deterioration in image quality of the whole resultant image occurred when the compression amount δ was changed in a range of 0.4–0.5 mm and to 0.9 mm. For the reason, it is conceivable that, although the quality of a resultant image is a little improved due to some increased rigidity of the roller shaft 20B as compared with the above case of the outer diameter M of the roller shaft 20B being 3 mm, the balance between the rigidity of the roller shaft 20B and that of the roller member 20C (the compression amount δ) can not properly be kept yet.

It is further found that, in the case of the outer diameter M being 5 mm and 6 mm respectively, a deterioration in image quality of the whole resultant image occurred when the compression amount δ was 0.4 mm and 0.9 mm respectively, and the whole resultant image excellent in quality could be obtained when the compression amount δ was in a range of 0.5–0.8 mm. It is conceivable that this is resulted from the following reason.

Specifically, in the case that the compression amount δ of the roller member 20C is small set to 0.4 mm and the rigidity of the roller member 20 is too large accordingly, the inferior charging of toner held on the roller member 20C is caused due to the compression amount δ of the roller member 20C being small in supplying toner to the developing roller 19. To the contrary, in the case that the compression amount δ of the roller member 20C is largely set to 0.9 mm and the rigidity of the roller member is too small accordingly, the rotational torque to the toner supply roller 20 increases due to the compression amount 6 of the roller member 20 becoming excessive in supplying toner to the developing roller 19, so that a clogging with toner is generated. Consequently, it is conceivable that there occurred a deterioration in image quality of the whole resultant image in each case that the compression amount δ is 0.4 mm or 0.9 mm. On the other hand, in the case that the compression amount δ is in a range of 0.5–0.8 mm, a good balance can be kept between the rigidity of the roller shaft 20B determined based on the outer diameter M thereof and the rigidity of the roller member 20C determined based on the compression amount δ, so that the whole resultant image excellent in quality can be obtained.

When the outer diameter M of the roller shaft 20B is set to 7 mm more than 6 mm, the insufficient supply of toner to the developing roller 19 is caused in each case of the compression amount δ of the roller member 20C set in a range of 0.4–0.8 mm, resulting in the deteriorated image quality of a resultant image. When the compression amount δ is set to more than 0.9 mm, there occurred a deterioration in image quality of the whole resultant image. It is conceivable that this is caused by that the roller shaft 20B has so enough rigidity not to bend when the outer diameter M of the roller shaft 20B is too large, while the thickness of the roller member 20C becomes smaller, so that the roller member 20C can not hold sufficiently toner thereon, and thus causing the insufficient supply of toner to the developing roller 19. As a result, a resultant image excellent in image quality could not be obtained.

As clearly found from the above description, to form a resultant image wholly excellent in image quality by keeping a proper balance between the rigidity determined based on the outer diameter M of the roller shaft 20B and that determined based on the compression amount δ of the roller member 20C, it is preferable that the outer diameter M of the roller shaft 20B is set in a range of 5–6 mm and the compression amount δ of the roller member 20C is set in a range of 0.5–0.8 mm.

In the toner supplying device according to the present embodiment, as mentioned above, the outer diameter L of the toner supply roller 20 is set in a range of 10–13 mm, the outer diameter M of the roller shaft 20B is set in a range of 5–6 mm, and a difference between the distance between the rotating center E1 of the toner supply roller 20 and the rotating center E2 of the developing roller 19 and the sum of the radius R1 of the toner supply roller 20 and the radius R2 of the developing roller 19, i.e., the compression amount δ of the roller member 20C is set in a range of 0.5–0.8 mm so that there is a good balance between the rigidity of the roller shaft 20B and the rigidity of the roller member 20C. Accordingly, with the toner supply roller 20 having a small roller diameter L, the sufficient supply of toner from the toner supply roller 20 to the developing roller 19 can be achieved. This makes it possible to form for a long period a resultant image excellent in image quality.

Since both the toner supply roller 20 and the developing roller 19 are driven to rotate in the same direction, a smoother flow of toner can achieved if a difference of rotating speed between the toner supply roller 20 and the developing roller 19 is properly determined.

Furthermore, the developing roller 19 being formed of elastomer such as hard rubber which is harder than the roller member 20C, the roller member 20C is compressed against the developing roller 19 when the toner supply roller 20 is in contact with the developing roller 19. The compression amount δ of the roller member 20C is determined based on the relation between the distance between the rotating center E1 of the toner supply roller 20 and the rotating center E2 of the developing roller 19 and the sum of the radius R1 of the toner supply roller 20 and the radius R2 of the developing roller 19. The rigidity of the roller member 20C with the compression amount δ determined in that way can keep a good balance with the rigidity of the roller shaft 20B determined based on the outer diameter M, so that the roller diameter L of the toner supply roller 20 can be reduced and the sufficient supply of toner from the toner supply roller 20 to the developing roller 19 can be achieved.

Furthermore, the width H of the roller member 20C of the toner supply roller 20 is set to 200 mm or more and 290 mm or less. In this case, based on that the rigidity of the roller member 20C is determined based on the compression amount δ thereof and the rigidity of the roller shaft 20B is determined based on the outer diameter M thereof, the roller diameter L of the toner supply roller 20 can be reduced and the sufficient supply of toner from the toner supply roller 20 to the developing roller 19 can be achieved.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner supplying device for developing an electrostatic latent image formed on an outer peripheral surface of a photosensitive drum by supplying toner to the image, and then transferring the developed image onto a sheet to form a resultant image, the toner supplying device comprising:

a toner storing member;

a toner supply roller for supplying toner transported from the toner storing member, constructed of a roller shaft and a porous elastomer covering a periphery of the roller shaft, an outer diameter of the toner supply roller being set in a range of 10–13 mm and an outer diameter of the roller shaft being set in a range of 4.5–6.5 mm; and a developing roller for supplying the toner supplied from the toner supply roller to the electrostatic latent image formed on the surface of the photosensitive drum to develop the image, a distance between a rotating center of the toner supply roller and a rotating center of the developing roller being set shorter by 0.5 mm–0.8 mm than a sum of a radius of the toner supply roller and a radius of the developing roller.

2. A toner supplying device according to claim 1, wherein said toner supply roller and said developing roller are driven to rotate in the same direction.

3. A toner supplying device according to claim 1, wherein said developing roller is formed of elastomer which is harder than the porous elastomer of the toner supply roller.

4. A toner supplying device according to claim 1, wherein a width of the porous elastomer of the toner supplying roller is set to 200 mm or more and 290 mm or less.

5. A toner supplying device according to claim 1, wherein a difference between the distance between the rotating center of the toner supply roller and the rotating center of the developing roller and the sum of the radius of the toner supply roller and the radius of the developing roller corresponds to a compression amount of the porous elastomer.

6. A toner supplying device according to claim 1, wherein the porous elastomer is made of sponge material.

7. A toner supplying device according to claim according to claim 3, wherein the elastomer of the developing roller is made of hard rubber.

8. A toner supplying device according to claim 1, wherein the outer diameter of the toner supply roller is set in a range of 11.5 mm±0.5 mm.

9. A toner supplying device according to claim 1, wherein the outer diameter of the roller shaft of the toner supply roller is set in a range of 5 mm±0.5 mm.

10. A toner supplying device according to claim 1, wherein the distance between the rotating center of the toner supply roller and the rotating center of the developing roller is set in a range of 0.6 mm±0.1 mm.

* * * * *